United States Patent [19]

Cattadoris

[11] Patent Number: 4,570,345

[45] Date of Patent: Feb. 18, 1986

[54] HOLDING AND MARKING FIXTURE FOR FLAT SHEETS

[76] Inventor: Joseph M. Cattadoris, 211 Booth St., Utica, N.Y. 13502

[21] Appl. No.: 648,036

[22] Filed: Sep. 6, 1984

[51] Int. Cl.[4] ..... B43L 13/00

[52] U.S. Cl. ..... 33/32 G; 33/32 R; 33/403

[58] Field of Search ..... 33/403, 169 R, 32 G, 33/32 R, 42, 411, 489

[56] References Cited

U.S. PATENT DOCUMENTS 2,435,382 2/1948 Caskey ..... 33/32 G
2,538,901 1/1957 Fancher ..... 33/32 G
2,619,775 12/1952 Judd, Jr. ..... 33/32 R
3,251,133 5/1966 Turtschan ..... 33/169 R

*Primary Examiner*—Willis Little
*Attorney, Agent, or Firm*—Bruns and Wall

[57] ABSTRACT

A holding fixture used to mark pieces of sheet material that includes a base and a pair of upraised support towers mounted upon the base. The towers each contain vertical slots for receiving a worksheet therein so that the sheet is supported in a vertical posture. Straight edges are slidably mounted in each of the towers on each side of the worksheet that are used to guide a marking tool so that straight horizontal lines can be made on either surface of the sheet. A scale is provided for adjusting the position of each straight edge.

8 Claims, 4 Drawing Figures

-15-

HOLDING AND MARKING FIXTURE FOR FLAT SHEETS

BACKGROUND OF THE INVENTION

This invention relates to apparatus for marking flat sheets of material and, in particular, to apparatus for rapidly laying out bend lines upon sheets of material so that the sheets can be accurately worked in a brake.

When bending sheets of material into various geometric shapes or configurations, it is the common practice in the art to first lay out or mark the bend lines on the surface of the sheet prior to loading the sheet in the brake. The bend lines provide a visual means by which the operator can properly align the sheets in the brake. Heretofore bend lines were typically located from some key datum plane or planes and initially marked by forming a series of dimple-like marks along the plane of the line using a prick punch. A straight edge was then aligned along the punch marks and a line marked using a scribing tool. When a small number of sheets were to be formed, each sheet was individually laid out by hand using a scale to determine the key points. As can be seen, this type of work is rather time consuming and tedious. Furthermore, because all of the numerous steps must be performed by hand, there is a high probability that one or more of the layouts will be inaccurate and the part fabricated therefrom will eventually have to be scrapped.

When a large number of similar sheets are to be fabricated, punch hole templates are usually constructed having guide holes formed therein for accurately locating and guiding the punch. The template is placed over the working surface of the sheet and is accurately located from a pair of edges so that the guide holes are accurately positioned over the sheet. After the punched holes have been formed, the template is removed from the sheet and the bend lines scribed using a straight edge and a marking tool. Here again, a large number of operations must be performed by hand using a variety of different tools. Accordingly, the accuracy of the layout is to a large extent still dependent upon the skill of the layout person.

The laying out of complex sheet metal forms often times further requires that both the front and back surfaces of the sheet be marked and the bend lines contained on the opposing surfaces be accurately located in relation to each other. This task is sometimes extremely difficult to carry out, particularly when the sheets are laid out on a flat horizontal working surface. As can be seen, the layout person is not readily able to relate a bend line on the top side of the sheet with one formed on the opposite or bottom side. As a consequence, even with the use of one or more templates, the process includes a number of different steps which provide considerable room for error.

As evidenced by U.S. Pat. Nos. 3,113,382 and 4,208,799, various types of apparatus have been developed which aid in the marking and cutting of sheet metal panels used for siding houses. However, these devices do not overcome the difficulties encountered when laying out flat sheets of bendable materials as noted above. U.S. Pat. No. 1,521,544 describes a carpenter's tool that can be adjusted to mark joint lines in timbers prior to the joints being cut. This device, however, is not adaptable for use in conjunction with thin sheets of materials to permit the accurate laying out of bend lines on the sheets of material.

SUMMARY OF THE INVENTION

This invention relates to an improved apparatus for marking bend lines on sheets of material.

A further object of the present invention is to eliminate inaccuracies when laying out flat sheets of materials prior to bending of the sheet into a desired form.

A still further object of the present invention is to reduce the amount of time required to layout a sheet of flat material prior to the bending thereof.

Yet another object of the present invention is to eliminate the number of steps required to accurately mark one or more bend lines on a sheet of flat material.

While a still further object of the present invention is to rapidly and accurately mark bend lines on either side of a flat sheet without having to reposition the sheet during the marking operation.

Another object of the present invention is to provide an adjustable holding fixture for flat bendable sheets of material which can be accurately set up so that the bend lines can be scribed on both sides of the sheet without the need of removing the sheet from the fixture.

These and other objects of the present invention are attained by means of a sheet marking fixture having spaced apart support towers. Each tower contains a front and a rear column that are separated by a slotted opening adapted to receive a worksheet therein and thus support the sheet in a vertical position. Straight edge members containing marking guides are slidably mounted upon the columns in coacting pairs so that at least one pair is situated on one side of the worksheet. The guides in a set are brought to the same elevation using a scale whereby two coplanar bend lines can be marked on the adjacent sheet surface that can be used to align the sheet in a brake. Locking screws are also provided for locking the straight edge members to the receiving columns.

BRIEF DESCRIPTION OF THE DRAWINGS

For a better understanding of these and other objects of the present invention, reference is had to the following detailed description of the invention which is to be read in conjunction with the accompanying drawings wherein.

DESCRIPTION OF THE INVENTION

Figures 1, 2, 3, 4:
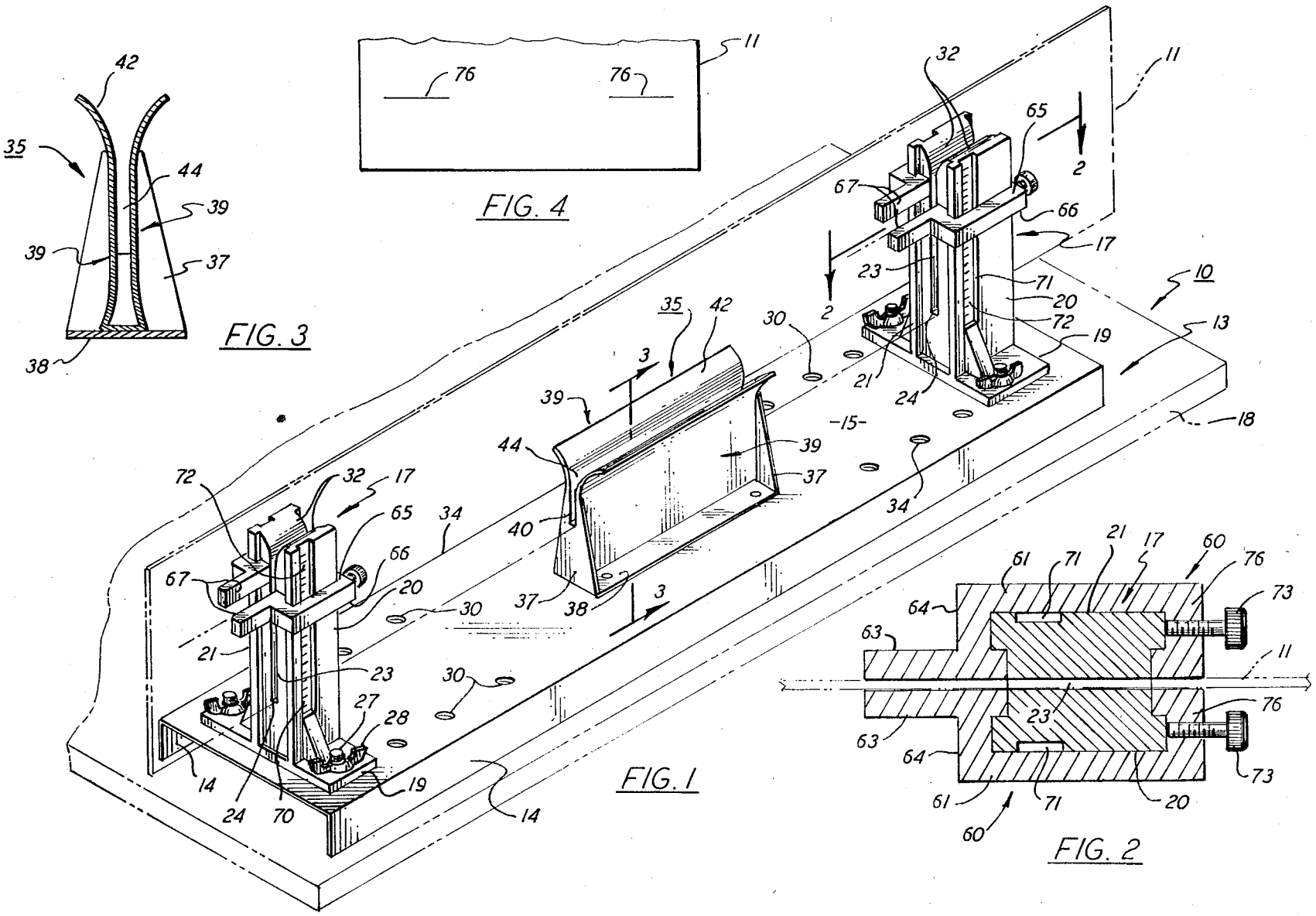
FIG. 1 is a perspective view of a sheet metal holding fixture embodying the teaching of the present invention.
FIG. 2 is a section taken through one of the support columns utilized in the present invention along lines 2—2 in FIG. 1.
FIG. 3 is a section taken along lines 3—3 in FIG. 1.
FIG. 4 is a partial plan view of a flat sheet of bendable material showing bend lines scribed on the surface thereof.

Referring now to the drawings, there is shown a holding fixture, generally referenced 10 for supporting a flat worksheet 11 in a vertical position so that both sides of the sheet can be accurately marked prior to its being bent in a brake or the like. The sheet, as herein shown, is formed of a bendable metal of the type used in the manufacture of heating and ventilating ducts. However, it should be obvious from the disclosure below that sheets of any type can be processed in the present fixture to produce any number of different line patterns thereon. The fixture includes a channel shaped base 13 having a pair of vertically disposed legs 14—14 and a flat horizontally disposed working surface 15. A pair of upraised support towers 17—17 of similar construction are seated upon the working surface of the base in spaced apart relationship as shown in FIG. 1. The fixture is easily portable and, when in use, the base will usually be seated upon a flat surface such as table 18.

Each tower is mounted upon a laterally disposed pedestal 19 between a pair of brackets 25—25. Preferably, the towers are fabricated from a single piece of material having a slotted opening 23 formed therein which separates the tower into a front vertical column 20 and a rear vertical column 21. Each slot is passed downwardly to the same depth whereby the bottom wall 24 of each slot is elevated the same distance above the working surface of the base. As best seen in FIG. 2, the towers are H-shaped with the slotted opening passing laterally through the mid line of the structure. The pedestals are secured to the base by holddown bolts 27—27 and coacting wing nuts 28—28. In assembly, the bolts are passed upwardly through two parallel rows of locating holes 30—30 formed in the base and are tightened down using the wing nuts to secure the towers in place. The locating holes are accurately machined in the base so that the towers can be selectively positioned at various locations along the length of the base. The towers can be thus moved towards or away from each other to change the spacing therebetween.

With the towers secured to the base, the two slotted openings 23—23 are aligned along a common plane so that a flat sheet of material, such as sheet 11, can be slidably received therein. The height of the columns is such that the sheet will be provided with sufficient support to hold the sheet in the vertical plane described by the slotted openings. An arcuate shaped lip 32 is provided in each column at the upper entrance to each slotted opening to permit the sheets to pass freely into the slots. In practice, the bottom edge 34 of the sheet 11 is registered against the coaligned bottom walls of the slotted openings thereby accurately aligning the sheet within the fixture without further adjustment.

A sheet stabilizer 35 is centrally positioned upon the base which is arranged to resiliently grip the opposing sides of the sheet 11 and help support the sheet in the fixture. With further reference to FIG. 3, the stabilizer includes a pair of triangular shaped end walls 37—37 that are connected by means of bottom wall 38 to form a U-shaped bracket. The bottom wall of the bracket is secured by any suitable means to the working surface of the base to support the endwalls in a raised position as shown. The end walls are furnished with cut outs 40—40 that allow a sheet loaded in the fixture to pass downwardly into the walls. A resilient holding element is mounted between the end walls of the bracket that is adapted to grip the opposing wall surfaces of a sheet guided into the bracket. The holding element is formed from a single piece of spring-like material and contains a base leg 41 that is secured to bottom wall 38 of the bracket and a pair of upwardly raised gripping arms 39—39. Each arm is rolled inwardly from an upper entrance 42 to form a restricted neck 44 through which the sheet passes. The arms are arranged to place a light biasing pressure against the opposing surfaces of the sheet to thus grip the sheet and help support it in a vertical position. The bottom surfaces 45 of the bracket cut outs may also be brought to the same elevations as the bottom walls of the tower openings 23—23 to further help support and align the sheet in the fixture.

Turning now more specifically to FIG. 2, there is illustrated a cross sectional view of the towers. As previously noted, each tower is separated by the slotted openings into a front column 20 and a rear column 21. The columns are each adapted to slidably receive therein one or more slide members generally depicted at 60. Each slide member includes a C-shaped body section and an outwardly disposed straight edge ruling guide 63 that depends from the end wall 64 of the body section. The opposed surfaces 65 and 66 of the slide member are parallel and, in assembly, lie in a horizontal plane. Front and rear guideways 56 and 57 are recessed within the end walls 53 and 54 respectively, of each column. The vertical guideways are adapted to receive therein lugs 68 and 69 that extend inwardly from the body section of the slide. The opening formed in the body section of the slide compliments the outer periphary of the receiving column to provide a close running fit therebetween. Accordingly, the slide members can move freely in the guideways with little or no play between the adjacent surfaces. The inside face 67 of the ruling guide is further arranged to parallel the slotted opening formed in each tower so that the guide will move in close proximity with a sheet registered in the fixture.

The outer face of each column includes a recessed opening 71 that contains a scale 72 which is marked by vertically disposed graduations. A thumbscrew 73 is threaded into a hole formed in the end wall 76 of each slide member and is adapted to be seated against the companion end wall of the receiving column. By tightening the thumbscrew against the column, the slide member is locked in place to accurately position the ruling guide adjacent to one of the sheet surfaces. Loosening the thumbscrew releases the slide member so that it can be vertically repositioned along the column. By use of the graduated scale, the top surface of the ruling guide can be accurately located in regard to a worksheet registered in the fixture.

The slide members are generally mounted in pairs on one side of the worksheet with the pair members each being set at the same elevation in one of the spaced apart towers. The sheet is marked using a scribing tool, or any other suitable marking device. The tool is drawn along the two ruling guides of any slide member pair to generate a set of lines 76—76 upon the sheet as illustrated in FIG. 4. The lines can be formed at either side edge of the sheet and thus will provide an extremely accurate guide for positioning the sheet in a brake so that a bend can be taken along the length of the sheet. As should be further evident, more than one pair of coacting slides can be mounted in the towers. For example, one or more pairs may be positioned on rear columns of the towers, while similarly, one or more pairs can be mounted on the front columns so that any member of various line patterns can be developed on the worksheet.

The present fixture can be quickly and accurately set-up to mark one or a plurality of sheets on one or both sides thereof. Once the fixture is set up, the sheets will be automatically registered in the fixture by simply bottoming the sheets in the tower openings. The close running fit between the slide members and the receiving columns further insures that the ruling guides will not become misaligned even after repeated usage.

While this invention has been described with specific reference to the above noted method, it should be clear to one skilled in the art that the invention is not limited by this disclosure.

I claim:

1. Apparatus for laying out flat sheets of material that includes a base that includes a flat horizontal working surface and a pair of spaced apart vertically disposed support towers mounted upon the working surface, each of said support towers having a front column and a rear column that are separated by a slotted opening, said slotted openings both lying in a common support plane and having bottom walls that are at the same elevation over the working surface of the base whereby a flat sheet mounted in the slots is supported in a vertical position, at least one horizontally disposed straight edge member slidably supported in corresponding columns in each tower so that the straight edge members can be vertically repositioned on the same side of a sheet supported between the towers, a horizontally disposed marking guide depending from each of said straight edge members, parallel with said common support plane, said guide having a horizontal edge for guiding a marking tool over the surface of a sheet to mark a straight line thereon, scale means carried upon each column for accurately locating the straight edge members and, releasable locking means associated with each straight edge member for releasably engaging the receiving column and thus securing the said member at a desired position in regard to a sheet mounted between the towers.

2. The apparatus of claim 1 that further includes a sheet stabilizer centrally mounted upon the working surface of the base having an opposed pair of inwardly biased spring members that are arranged to resiliently grip the opposing walls of a sheet mounted between the towers.

3. The apparatus of claim 1 that includes a first pair of straight edge members mounted upon the front columns of the tower and a second pair of straight edge members mounted upon the rear columns of the towers.

4. The apparatus of claim 1 that further includes a locating means for adjustably securing the tower upon the base at different locations so that the spacing between the towers can be varied.

5. The apparatus of claim 1 where each straight edge member contains at least one inwardly disposed rail that is slidably received within a vertical guideway formed in the receiving column.

6. The apparatus of claim 5 wherein the top and bottom surfaces of the straight edge members are parallel.

7. The apparatus of claim 1 that further includes a graduated scale carried upon each of the columns having horizontal scale lines for aligning the straight edge member at a desired elevation.

8. The apparatus of claim 7 wherein the scale is mounted in a vertically disposed recess formed in the containing column.

* * * * *